US005295628A

United States Patent [19]

Zuckschwerdt

[11] Patent Number: 5,295,628

[45] Date of Patent: Mar. 22, 1994

[54] DISCHARGE NOZZLE FOR MEDIA

[75] Inventor: Fritz Zuckschwerdt, Radolfzell, Fed. Rep. of Germany

[73] Assignee: Ing. Erich Pfeiffer GmbH & Co. KG, Radolfzell, Fed. Rep. of Germany

[21] Appl. No.: 828,775

[22] Filed: Jan. 30, 1992

[30] Foreign Application Priority Data

Jan. 30, 1991 [DE] Fed. Rep. of Germany ..... 4102632

[51] Int. Cl.[5] ..... B05B 1/34; B05B 7/00

[52] U.S. Cl. ..... 239/590.5; 239/432; 239/434; 239/543

[58] Field of Search ..... 239/432, 434, 590, 590.5, 239/399, 403, 337, 343, 543

[56] References Cited

U.S. PATENT DOCUMENTS

| | | | |
|---|---|---|---|
| 2,551,114 | 5/1951 | Goddard . | |
| 3,503,559 | 3/1970 | Torretta | 239/337 |
| 4,055,302 | 10/1977 | Hruby, Jr. | 239/590.5 |
| 4,076,174 | 2/1978 | Volgel et al. | 239/590.5 |
| 4,343,434 | 8/1982 | Haruch . | |
| 4,815,665 | 3/1989 | Haruch . | |
| 4,828,182 | 5/1989 | Haruch . | |
| 4,899,937 | 2/1990 | Haruch . | |
| 5,139,201 | 8/1992 | De Laforcade | 239/590 |

FOREIGN PATENT DOCUMENTS

| | | | |
|---|---|---|---|
| 0577048 | 5/1933 | Fed. Rep. of Germany . | |
| 2722469 | 11/1978 | Fed. Rep. of Germany . | |
| 3128002 | 3/1982 | Fed. Rep. of Germany . | |
| 0324350 | 10/1957 | Switzerland . | |
| 424660 | 5/1967 | Switzerland | 239/337 |
| 1027475 | 7/1983 | U.S.S.R. | 239/432 |
| 1036392 | 8/1983 | U.S.S.R. | 239/432 |
| 1570787 | 6/1990 | U.S.S.R. | 239/590.5 |
| 2081606 | 2/1982 | United Kingdom | 239/432 |

*Primary Examiner*—Andres Kashnikow
*Assistant Examiner*—Christopher G. Trainor
*Attorney, Agent, or Firm*—Quarles & Brady

[57] ABSTRACT

In a discharge nozzle (1) through an inner nozzle opening (44) liquid is sprayed in a spray cone against a pointed conical guidance surface (47) in a chamber (29) and in its zone at the nozzle opening (44) said spray cone is transversely exposed to the action of a compressed air flow from a transverse inlet (27). Roughly facing the transverse inlet (27) in a slot-shaped channel portion (30) of the chamber (29) an air flow is passed from a longitudinal inlet (28) to a chamber outlet (52), to which is transferred the aerosol produced in the chamber (29), which is accelerated and then, after deflection at (31), is directed in the opposite direction against the impact surface (34) of an impact atomizer (20), where there is a deflection (32) in the opposite direction and then the very fine aerosol is immediately discharged through an end channel portion (37) and an outlet (38) into the open.

24 Claims, 2 Drawing Sheets

Figure 1:
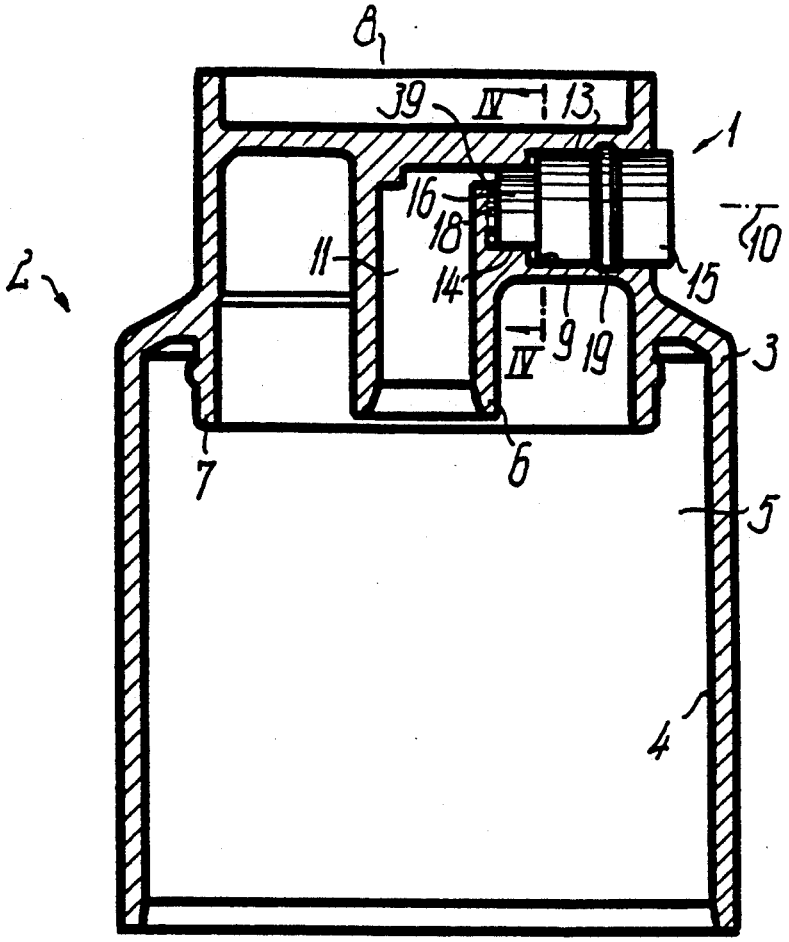

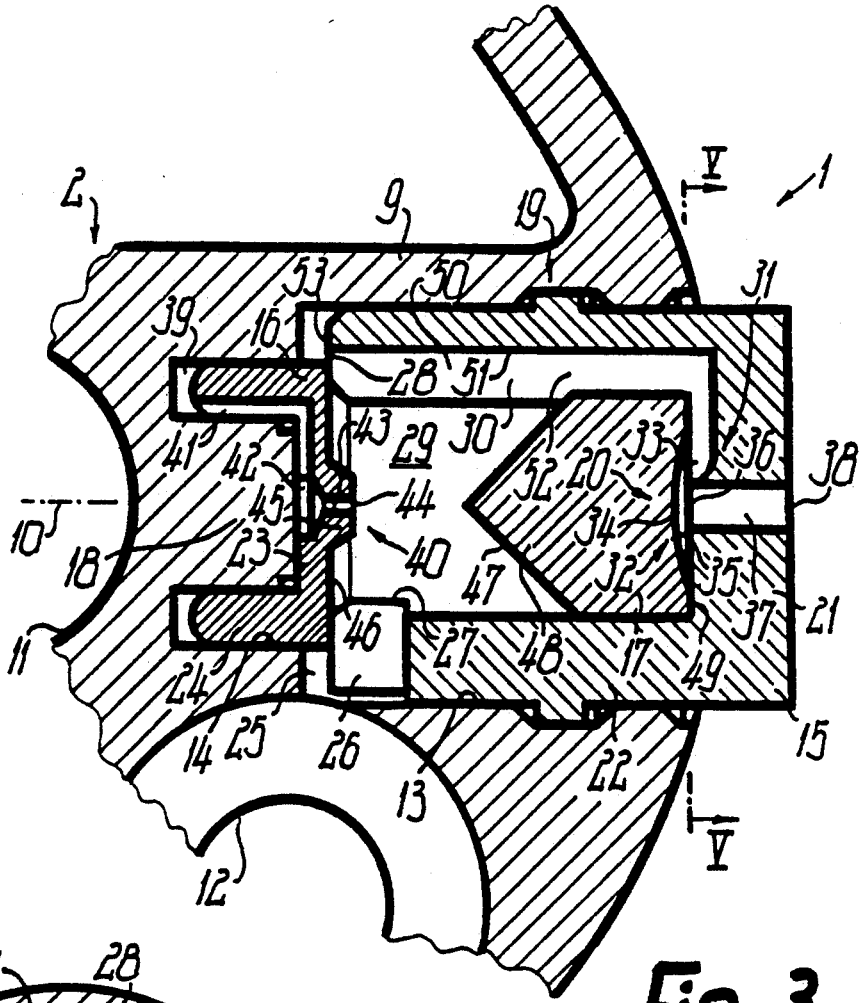
Fig.3
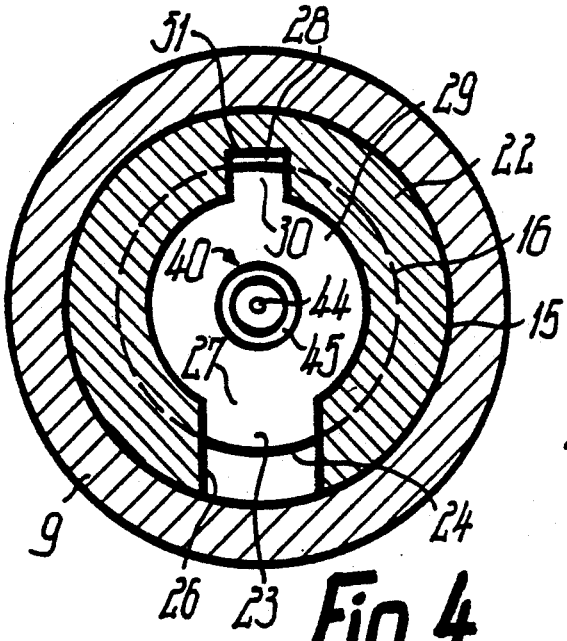
Fig.4
Fig.5
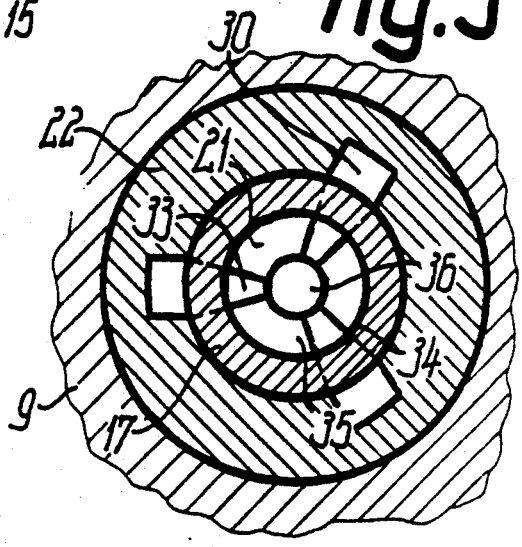

DISCHARGE NOZZLE FOR MEDIA

DESCRIPTION

The invention relates to a discharge nozzle, particularly for flowable, atomizable media, such as are e.g. formed by aqueous, oily or similar liquids, but also other substances. The discharge nozzle arrangement or unit is in particular suitable for such discharge apparatuses which are operated manually for the discharge either in a pump movement and/or in a valve opening movement, as for aerosol doses. Such discharge nozzles are usually very small and have nozzle openings or channels with a width or diameter of less than 0.5 to 1 mm.

Particularly when discharging small medium quantity doses, which can only be delivered under a relatively low or non-uniform pressure, a preparation in the form of very finely divided droplets or in a fine spray mist is very difficult and even with multistage nozzle atomization it has scarcely been possible hitherto to obtain a droplet size below roughly 20 μ.

The problem of the invention is to provide a discharge nozzle for media, in which the disadvantages of known constructions are avoided and which in particular in a relatively simple manner permits a very accurately determinable, homogeneous and/or ultra-fine atomization.

According to the invention, this problem is solved in that two or more simultaneously or successively operating atomizers are provided, which operate according to at least one of the atomizer principles constituted by impact or rebound atomization, vortex atomization, flow atomization accompanied by an accelerated flow rate, compressed gas atomization and a break-off or spray cone atomization emanating from a nozzle opening. As a function of the atomization-relevant characteristics of the medium to be atomized one or more such atomization types can be provided and it is e.g. possible to conceive a discharge nozzle without using impact atomization.

However, it is preferable and also advantageous for most media to have at least an impact or rebound atomization, which preferably takes place immediately before the discharge of the medium from the nozzle outlet leading into the open. Instead of or in addition thereto, a deflection or reversing atomization can be provided in such a way that prior to discharge the fluid flow undergoes at least one deflection with an angle between 100° and 180° and is therefore subject to significant flow distortions. The fluid flow can initially be deflected counter to the main flow direction of the discharge nozzle without a guide and is then immediately deflected in the opposite direction. Instead of allowing the fluid flow to impact at high flow rates on a fluid cushion, appropriately an impact surface is provided, against which is directed a directional nozzle and which forms a rounded guidance surface for deflecting the fluid flow.

Instead of or in addition to this it is also possible to provide a spray cone medium nozzle directed into a vortex chamber, which is directed against inclined guidance surfaces, where the fluid flow can be converted into an annular roll flow surrounding the nozzle axis. A flow distrubance for increasing the turbulence effect can be produced by a flow directed at right angles to the nozzle or chamber axis, which flows round a nozzle having the outlet of the other nozzle on the front on opposite sides and at the front, so that there is also a break-off atomization at the nozzle projection edges.

As a result of a concentrated, strand-like longitudinal flow substantially independent of the flow conditions in the remaining chamber and which takes place along part of the chamber circumference, against which appropriately no transverse flow is directed, it is possible to obtain a highly differential flow between the actual vortex flow in the chamber and the longitudinal flow. In the interface between these two flows high atomization forces can act. In addition, the longitudinal flow can be directed against the chamber outlet roughly corresponding to its cross-section, so that with the assistance of medium atomized by the transverse flow from the remaining chamber and accompanied by compression or acceleration/deceleration is forced out of the chamber outlet.

The chamber cross-section from at least one or all the inlets located in the vicinity of the chamber end can be substantially constant and/or decrease over part of the chamber length and is appropriately almost constant over more than half the chamber length or over the part of its length extending beyond the transverse flow and then decreases over the remaining, roughly equal part of the length up to the other chamber end or to the outlet. This leads to a ring funnel-like constriction towards the chamber outlet.

The atomizing effect can also be improved in that a medium nozzle, which produces a spray cone, is directed within a chamber against at least one inclined guidance surface, which is inclined radially outwards or rearwards from the nozzle axis in the spray direction, so that the spray jet impacts under an acute angle and not a right angle. This guidance surface, which appropriately extends up to the inner circumference of the chamber, can in simple manner be formed by a conical or pointed conical ring face, whose average diameter roughly corresponds to the maximum impact diameter of the spray cone. The apex or tip of this cone, which has a cone angle of approximately 90°, is directed against the medium nozzle at a much greater distance compared with the nozzle opening width and can have a distance from the medium nozzle, which is roughly half the inside diameter of the chamber. The cone forms the chamber end wall diverging from the planar shape and facing the medium nozzle. Appropriately in the vicinity of its cone tip this end wall has a minimum spacing from the transverse flow, which is roughly the same as the parallel cross-sectional extension of the transverse flow or the associated flow inlet.

It is particularly appropriate to use a process in which liquid medium, initially without prior air admixing, is sprayed under preceding twisting axially into the chamber and against the facing sloping guidance surfaces, is subject to the action of an air flow at right angles to the spray cone before leaving the spray nozzle and is then transferred from the main part of the chamber into a longitudinal air flow from which the atomized medium is removed through a chamber outlet and after deflecting twice by initially roughly 90° and then roughly 45° is directed against the impact surface. From the latter the medium is directly discharged to the outside through the final channel portion forming the discharge nozzle outlet leading into the open. It has been found that if at the outlet of the medium nozzle a spray droplet size of approximately 70 to 100 μ is to be obtained, the droplet size at the discharge opening is only 8 μ. It is important that the medium flow directed against the impact surface, after impacting, is not guided back on an outer edge of the impact surface to its rear and is instead virtually reflected in the opposite direction on said impact surface and is conveyed on in this reflection direction. Thus, the impact surface forms the bottom of a substantially closed, very shallow, lenticular or semilenticular chamber, whose boundaries are only open in the vicinity of at least one inlet and at least one outlet.

The discharge nozzle can be produced very easily from two nozzle caps to be inserted in a body, whereof one receives in the interior a core body, which forms with one face the impact surface and/or with the other face the inclined guidance surface. At the rear end this nozzle cap is appropriately closed substantially by the other nozzle cap having a smaller outside diameter in such a way that on the one hand inlets are left open for the transverse and/or longitudinal flow and on the other the rear end of the chamber surrounded by the front nozzle cap is closed.

The inventive discharge nozzle is particularly suitable for discharge apparatuses, which have two pumps to be operated simultaneously with a single handle, namely a thrust piston liquid pump sucking from a storage vessel and a compressed air pump, so that both media can be supplied to the discharge nozzle under an overpressure and optionally with a delayed controlled delivery start or finish. Such a discharge apparatus is described in DE-OS 27 22 469, to which reference should be made for further details and effects.

These and other features of the invention can be gathered from the claims, description and drawings and the individual features, either alone or in the form of subcombinations, can be realized in an embodiment of the invention and in other fields and can represent advantageous, independently protectable constructions for which protection is hereby claimed. An embodiment of the invention is described hereinafter relative to the drawings, wherein show:

FIG.1 An inventive discharge nozzle on an operating and discharge head in axial section.

Figure 2:
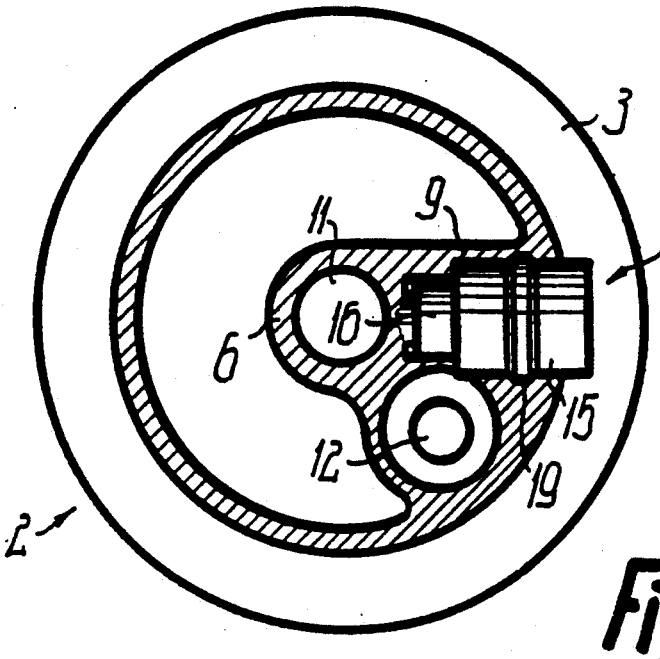

FIG. 2 A cross-section through the arrangement of FIG. 1.

FIG. 3 A larger-scale detail of the cross-section of FIG. 2 with a sectional discharge nozzle.

FIG. 4 A cross-section along line IV—IV of FIG. 1.

FIG. 5 A cross-section along line V—V in FIG. 3.

The discharge nozzle 1 made completely from plastic injection mouldings is located on a substantially thin-walled, casing-like body 2, which serves to project with a cap 3 over a discharge apparatus having at least two parallel-operating pumps. The jacket or casing of the cap 3 forms the cylinder 4 for the piston of an air pump and defines between said piston and the cap end wall a pressure chamber 5. In the centre of the cap end wall is provided a plug flange 6 directed into the cap for plug connection with the operating or piston plunger of a medium pump, which displaceably and in sealed manner traverses the air pump piston. The medium pump can have at least one delivery valve, so that only as from a predetermined pressure in the medium pump chamber is there delivery into the plug flange 6. The plug flange 6 is surrounded by a further plug flange 7 located within the cap jacket, which receives an end wall frontally bounding the pressure chamber 5 and which receives at least one delivery valve of the air pump, so that it also only supplies air to the discharge nozzle after reaching a given chamber pressure. The delivery valves can be adjusted in such a way that the start or finish of air delivery is e.g. so time-shifted with respect to that of the medium, that the start of air delivery commences before the start of medium delivery and/or the end of air delivery is after the end of medium delivery.

The outer end of the body 2 remote from the discharge apparatus forms a pressure handle for manual operation of at least one or all the pumps by finger pressure, which gives a purely manual pump drive. Between the handle 8 and the pressure chamber 5 the body 2 forms a nozzle flange 9 directed transversely to its cap axis for receiving and mounting in positionally fixed manner the three separate nozzle components substantially forming the nozzle insert of the discharge nozzle 1. Therefore the nozzle axis 2 is radially or at right angles to the actuation direction. The plug flange 6 bounds an approximately right-angled medium channel 11, which connects the outlet channel traversing the operating plunger in liquid-carrying manner to the inner or rear end of the discharge nozzle 1.

Roughly axially parallel to and alongside the medium channel 11 is provided an air channel 12, which connects the pressure chamber 5 to the discharge nozzle 1 between its rear and front end. The nozzle flange 9 forms a front or further reception bore 13 extending up to the outer circumference of the body 2 and to whose bottom is connected a roughly equiaxial, but narrower, shorter and annular reception bore 14. In the core-free reception bore 13 is inserted in fixed manner a front nozzle body 15, which can slightly project axially over the outer circumference of the body 2. In the reception bore 14 is inserted beforehand in frictionally engaging manner a smaller nozzle body 16 up to the stop member, against whose front end axially engages the nozzle body 15. In the nozzle body 15 is inserted a separate core body 17, whilst a core body 18 strike-engaging in the nozzle body 16 is constructed in one piece with the body 2, namely being formed by the bore core of the annular reception bore 14. The core body 15 is axially secured relative to the body 2 by a snap connection 19 located on its circumference, so that indirectly the nozzle body 16 is also axially secured. Within the nozzle body, the discharge nozzle 1 has various successive atomizing and mixing stages. There is in particular an impact atomizer 20, which is traversed by the medium flow, after covering most of its flow path through the discharge nozzle 1. This impact atomizer 20 is in the vicinity of the inside of a cap end wall 21 of the nozzle body 15, which forms the outer end of the discharge nozzle 1 and whose inside and/or outside is substantially planar. The cap jacket 22 of the nozzle body 15 projects over the inside, is inserted in sealed manner in the reception bore 13 and has between its ends on the outer circumference the snap connection 19.

Correspondingly the nozzle body 16 has a front cap end wall 23, whose substantially planar inside impacts against the front end wall of the core body 18. The cap jacket 24 projecting over said inside engages in fixed or substantially sealed manner in both the inner and outer circumference of the reception bore 14. The outside diameter of the nozzle body 16 is roughly one third smaller than that of the nozzle body 15, but is larger than its inside diameter.

The rear ends of the nozzle body 15 and the reception bore 13, as well as the outer circumference of the front end of the nozzle body 16 is bounded a flat, annular channel portion 25 which also surrounds the same and to which is tangentially connected a widened end portion of the air channel 12 on a narrow bounded circumferential zone. In the vicinity of the latter the rear end of the cap jacket 22 is provided with a through radial slot, which has a channel portion 26 radial to the common nozzle axis 10 of the nozzle bodies 15, 16, as well as forming a cross-section 27 with its radially inner end on the inner circumference of the cap jacket 22.

Circumferentially spaced therefrom and in particular diametrically facing it, on the rear end of the cap jacket 22 in the vicinity of its inner circumference is provided a longitudinal inlet 28, which is significantly narrower than the transverse inlet 27, but is also directly connected to the channel portion 25 through being located substantially in its front, annular boundary surface. The inner circumference of the cap jacket 22 has a substantially constant cross-section between its rear end and the core body 17 or, with the latter removed, over the entire jacket length. Between the core body 17 and the rear end of the cap jacket 22 is defined in the latter a chamber 29 roughly located in the nozzle axis 10 and which is free from fittings or interruptions over roughly half its length and its entire cross-section. The transverse inlet 27 substantially connected to the rear chamber end issues into said chamber.

In the inner circumference of the cap jacket 22 or the chamber 29 is provided at least one lowered, linear and smooth-walled channel portion 30 roughly parallel to the chamber axis, which can diametrically face the transverse inlet 27 and into whose rear end issues the longitudinal inlet 28. The channel portion 30 extends from the rear end of the cap jacket 22 to the inside of the cap end wall 21, on which it passes roughly at right angles into a channel leg directed against the associated nozzle axis 10. This channel leg does not extend up to the nozzle axis 10 and forms on its radially inner end a further flow deflection 31 with a deflection angle between approximately 45° and 90°, through which the flow is deflected counter to the flow direction in the channel portion 30 or counter to the aerosol exit direction from the discharge nozzle 1 in such a way that directed rearwards by a directional nozzle 33 it passes out at an acute angle against the axis of the impact atomizer 20. The directional nozzle 33 is substantially formed by the radially inner end of the channel leg and is roughly located in the plane of the inside of the cap end wall 21.

The impact atomizer 20 forms a further flow deflection 32, which deflects the flow in the opposite direction, namely once again in the exit direction from the discharge nozzle 1. For this purpose the impact atomizer 20 has a trough-shaped, flat or spherical cup-shaped impact surface 34, whose centre of curvature is upstream of the front end of the discharge nozzle 1 in its axis. The outside diameter of the impact depression is much larger than its depth, the directional nozzle 33, following on the circumferential boundary, faces the impact surface 34 and has a much smaller surface than the latter. The impact surface 34 forms the bottom of a deflecting chamber 35, whose facing wall is substantially planar and which has its greatest depth in the centre, so that it tapers outwards under a few radians in axial section from its centre to the outer circumference.

In the opposite end wall and with substantially no spacing alongside the directional nozzle 33 is provided the chamber outlet 36, which is formed by the rear end of a channel portion 37, whose front end forms the outlet 38 of the discharge nozzle 1 leading into the open and roughly in the plane of the front face of the cap end wall 21. Over virtually its entire length the channel portion 37 has substantially constant internal cross-sections, so that the outlet 36 is defined over substantially its entire circumference in the plane of the inside of the cap end wall 21. The directional nozzle 33 surrounds the circumferential boundary of the outlet 36 over a larger arc angle of e.g. 180°, the nozzle 33 and the outlet 36 only being separated from one another by a narrow burr. The width of the outlet 36 is much less than the outside diameter of the impact surface 34, but its passage cross-section is roughly the same as that of the directional nozzle 33. It is also conceivable to have two or more uniformly circumferentially distributed longitudinal channels 30 with associated longitudinal inlets 28 and directional nozzles 33.

Between the rear ends of the cap jacket 24 and the annular or reception bore 14 is provided in annular manner around the associated nozzle axis 10 a channel portion 39, into which issues the medium channel in the vicinity of a defined circumferential zone and by means of which the medium nozzle 40 formed by the nozzle body 16 is supplied under pressure with liquid medium. On the inner circumference of the cap jacket 14 is provided at least one groove-like, roughly axial channel portion 41 emanating from its rear end and which is continued in the inside of the cap end wall 23 by a radial channel portion, which issues into a twisting device 42 located in the nozzle axis. It is e.g. formed by a circular groove on the front end and outer circumference of the core body 18, as well as on the inside of the cap end wall 23 by a widened chamber, into which tangentially issues the channel leg, so that the inflowing medium is rotated about the nozzle axis.

At the outlet this chamber passes into a constricted channel portion 43, which is located in the nozzle axis, has constant cross-sections over its length and with its front end forms the nozzle opening 44 of the medium nozzle 40. The medium opening 44 is located in the front, planar face of a frustum-shaped nozzle projection 45, which projects over the remaining front of the cap end wall 23 and has a much smaller outside diameter than the inside diameter of the chamber 29. The annular, planar, front face of the nozzle body 16 forms with the nozzle projection 45 the rear end wall 46 of the chamber 29, into which projects a portion of the projection 45. With said face the nozzle body 16 engages on the rear, substantially planar end 53 of the nozzle body 15 in such a way that although the chamber 29 is substantially rearwardly sealed, but the longitudinal inlet or inlets 28 remain free and the channel portion 26 in the plane of the rear end 53 is at least bounded over the entire circumference over a radially inner part of its length. Thus, along the rear end wall 46, the transverse inlet 27 is radially directed against the nozzle projection 45, the transverse inlet 27 projecting further forwards than the nozzle projection 45, so that part of the flow from the transverse inlet 27 flows in unhindered manner in front of the nozzle opening 44, whereas a rear part flows round the nozzle projection 45.

The front end of the chamber 29 is bounded by a pointed cone-shaped guidance surface 47, whose point is directed in the nozzle axis against the nozzle opening 44, but is substantially outside the direct inflow of the transverse inlet 27. The pointed cone 48 is formed in one piece through the rear end of the core body 17, in whose front face 49 is formed as a depression the impact surface 34. Between said face 49 and the pointed cone 48 the core body 17 has an e.g. cylindrical portion with substantially constant outside crosssections, with which the core body 17 is so fixed in the inner circumference of the cap jacket 22, that its front face 49 sealingly engages on the inner face of the cap end wall 21.

The longitudinal channel 30 is formed by a longitudinal slot 50, whose open slot longitudinal side is located in the inner circumference of the cap jacket 22 and is directed against the nozzle axis 10. The longitudinal inlet 28 only extends over part of the depth of the longitudinal slot 50 connected to the slot bottom 51, because the radial spacing of the slot bottom 51 from the nozzle axis 10 is slightly larger than the outer circumference of the nozzle body 16 in the vicinity of its engagement on the rear end 53. The radial extension of the longitudinal inlet 28 is much smaller than half the slot depth. Consequently the longitudinal inlet 28 forms a slit bounded on one longitudinal side by the slot bottom 51 and on the other longitudinal side by the outer circumference of the nozzle body 16, so that its longitudinal direction extends around the nozzle axis 10.

In the area connected to the cap end wall 21 the longitudinal opening of the slot 50 is closed by the cylindrical portion of the core body 17, so that here the channel portion 30 is cross-sectionally closed over its circumference, whereas between the end walls of the chamber 29 on its radially inner longitudinal side it is substantially open to its full width. The flanks of the channel portion 30 can be approximately parallel to one another or can slightly diverge towards the open longitudinal side. The guidance surface 47 extends up to the start of the part of the channel portion 30 closed over the circumference and which at this point forms the single chamber outlet 52, although corresponding to the channel portions 30 there can also be two or three circumferentially distributed chamber outlets. Adjacent to the directional nozzle 33 or the impact surface 34 the open slot longitudinal side of the associated radial channel leg is closed by the front face 49 of the core body 17.

The discharge nozzle operates according to the following process. On pressing down the handle 8 air is forced out of the pressure chamber 5, via the air channel 12 into the channel portion 25 and from there both through the transverse inlet 27 into the chamber 29 and through the longitudinal inlet 28 along the slot bottom 51 into the channel portion 30. Simultaneously or slightly later the medium pump forces, via the medium channel 11, liquid into the channel portion 39 and through the channel portion 41 into the twisting device 42, so that out of the nozzle opening 44 passes an aerosol spray cone into the chamber 29, which is directed against the guidance surface 47. On leaving the nozzle opening 44 the spray cone is engaged by the air flow from the transverse inlet 27 and is on the one hand subject to increasing turbulence and on the other is at least partly forced against the open slot longitudinal side of the channel portion 30, along whose channel bottom 51 flows an air flow at a relatively high flow rate from the longitudinal inlet 28 to the outlet 52, so that the aerosol formed cannot be deposited on the inner faces of the channel portion 30. Thus, on at least one nozzle channel portion 30 of a discharge nozzle 1 is provided a flowing gas or air cover, so as to deliver the already formed aerosol with substantially no wall contact.

Large parts of the spray cone passing out of the nozzle opening 44 simultaneously strike the guidance surface 47, from which they are deflected radially outwards against the inner circumference of the chamber 29, said flow being simultaneously rotated about the nozzle axis 10 by the twisting device 42. Thus, in the chamber 29, whose internal cross-section is reduced towards the front end through the pointed cone 48, there is a very marked turbulence effect with a considerable acceleration or deceleration of the flow rate in the vicinity of the outlet 52, through which the aerosol now having a high air proportion leaves the substantially closed chamber 29. Whilst keeping the flow rate roughly constant or on further speeding it up, said aerosol is passed directly via the deflection 31 of the directional nozzle 33 formed by its outlet and is pressed against the impact surface 34. Accompanied by a further increase in the degree of fineness the aerosol is again deflected on the impact surface 34 and discharged via the channel portion 37.

The length of the channel portion 37 is much greater than its internal width, which is in turn much greater than that of the channel portion 43. The total passage cross-section of the air inlets 27, 28 is much larger than the passage cross-section of the channel portion 37 and appropriately the passage cross-section of the longitudinal inlet 28 is much smaller than that of the transverse inlet 27. The boundary edges of at least one or all the inlets or outlets can appropriately be sharp, in order to obtain favourable break-off flows. The passage cross-section of the channel portion 30 is appropriately much larger than that of the longitudinal inlet 28 and the width of the transverse inlet 27 can be roughly the same or larger than the outside diameter of the nozzle projection 45. The passage cross-section of the channel portion 30 or the directional nozzle 33 can be roughly the same as the passage cross-section of the channel portion 37.

In order to create even more favourable flow conditions for aerosol formation, the passage cross-section of the radial channel leg or legs connecting on to the channel portions 30 can be continuously constricted in the flow direction in such a way that the facing channel flanks converge at an acute angle. The overall passage cross-section of the directional nozzle or nozzles 33 is then advantageously smaller than the passage cross-section of the channel portion 37, but smaller than the overall passage cross-section of the longitudinal inlet or inlets 28. In this construction each directional nozzle 33 only extends over a relatively small arc angle of the circumference of the outlet 36, so that adjacent directional nozzles 33 can be at a greater distance from one another. The transverse inlet 27 can be advantageously positioned in such a way that it directly faces no channel portion 30 and is instead, e.g. in the case of three uniformly distributed channel portions 30, immediately adjacent to one of these.

FIGS. 3 and 4 show an embodiment with a single channel portion 30 facing the inlet 27, whilst FIG. 5 shows an embodiment with three channel portions 30, whereof none directly diametrically faces the inlet 27.

What we claim is:

1. A discharge nozzle for discharging at least one medium, comprising:

at least one nozzle duct having duct sections;

a nozzle outlet, and at least one distributing section for finely distributing a first medium of said at least one medium to an expanded volume;

wherein said at least one distributing section comprises a distributing chamber for receiving the finely distributed first medium;

a supply opening issuing into said distributing chamber for distributing the first medium from said supply opening into said distributing chamber;

flow generating means for generating the finely distributed first medium out of said distributing chamber and for distributing the first medium to a higher degree of atomization inside said distributing chamber, and flow varying means including at least one guiding face in said distributing chamber for varying the flow direction of the medium by a deflection angle between 45° and 360°.

2. The discharge nozzle according to claim 1, wherein said distributing chamber is bounded by an insert body providing said guiding face.

3. The discharge nozzle according to claim 2, wherein said distributing chamber has an inner circumference and at least one end boundary, said insert body extending substantially up to at least one of said end boundary and said inner circumference.

4. The discharge nozzle according to claim 1, wherein said distributing chamber comprises at least two mutually spaced successive distributing stages for providing at least one preceding distributing degree of atomization and at least one subsequent distributing degree of atomization, said at least one subsequent distributing degree of atomization being finer than said at least one preceding distributing degree of atomization.

5. The discharge nozzle according to claim 1, wherein said flow varying means further comprises an impact surface, and wherein said flow generating means includes means for exposing the first medium to a high flow rated second medium, the first medium being further atomized by at least one of tearing off the first medium from medium receiving faces, and rebounding the first medium on rebounding faces.

6. The discharge nozzle according to claim 1, wherein said supply opening distributes said first medium substantially free from a positively admixing second medium entering the chamber upstream of said supply opening, said second medium subsequently picking up and conveying the first medium out of the distributing chamber.

7. The discharge nozzle according to claim 1, wherein said at least one nozzle duct provides a plurality of subsequent flow deflections spaced from one another.

8. The discharge nozzle according to claim 1, wherein said flow varying means includes first and second flow deflectors, at least one first flow deflector defining a deflection angle of at least 45°, at least one second flow deflector being located downstream of said at least one first flow deflector, said at least one second flow deflector deflecting in a direction counter to a direction of deflection for said at least one first flow deflector.

9. The discharge nozzle according to claim 1, further comprising at least one impact atomizer having at least one directional nozzle upstream of said nozzle outlet, said at least one impact atomizer having a deflecting surface facing substantially towards said nozzle outlet, said directional nozzle being directed toward said deflecting surface.

10. The discharge nozzle according to claim 1, wherein said flow varying means includes deflecting surfaces, at least one of said deflecting surfaces being located directly adjacent to an upstream end of one of said duct sections, at least one of said duct sections further comprising at least one of an overall substantially linear duct, a duct of overall substantially constant cross-section, a portion of said nozzle outlet at an end remote from said upstream end of one of the duct sections, a sharp edge at said upstream end of one of the duct sections, a duct of a length extension greater than an internal width extension, an edge positioned at said upstream end of one of the duct sections, said edge directly passing into at least one directional nozzle, and a deflection receiving duct.

11. The discharge nozzle according to claim 10, wherein at least one of said deflecting surfaces has greater surface area than a cross-section of at least one of said duct sections provided downstream of said deflecting surface.

12. The discharge nozzle according to claim 10, wherein at least one of said deflecting surfaces defines at least one of a depth extension and a width extension, wherein at least one of said duct sections is located downstream of said deflecting surface and defines a greatest width extension that is at least one of greater than said depth extension of said at least one deflecting surface, and smaller than said width extension of said at least one deflecting surface.

13. The discharge nozzle according to claim 1, wherein said flow varying means includes a deflecting surface, said deflecting surface being located near an upstream end of one of said duct sections, wherein said supply opening is connected to said upstream end of one of said duct sections and is juxtaposed with said deflecting surface, said supply opening and said upstream end being located on a same side of said deflecting surface and substantially in a common plane, said supply opening providing at least one of a passage cross-section smaller than a clear opening crosssection of said duct section, an eccentric position with respect to said upstream end, a location adjacent to a peripheral edge of said deflecting surface, a location adjacent to a boundary portion of said upstream end, and an orientation inclined in relation to a center of said deflecting surface.

14. The discharge nozzle according to claim 1, wherein said guiding face provides a deflecting surface and said distributing chamber provides a flat deflection chamber, said deflecting surface providing a closed end face of said deflection chamber, a substantially planar counter face opposing said deflecting surface and being substantially only perforated by an upstream end of one of said duct sections and said supply opening, in cross-section said deflection chamber being circumferentially bounded at an acute angle.

15. The discharge nozzle according to claim 1, further comprising a core body in said distributing section, said core body having a frontal end face and enveloped by an inner circumferential surface, said frontal end surface resting substantially sealingly against a counter surface, at least one of an upstream end of one of said duct sections and said supply opening perforating said counter surface, said frontal end surface providing a deflection surface.

16. The discharge nozzle according to claim 15, wherein at least one of said duct sections provides a supply channel for said supply opening, said supply channel being bounded by a groove, said groove being provided in said counter surface and said inner circumferential surface longitudinally projecting over said core body, said groove providing an open length side connecting to said supply opening, said open length side being closed by said core body, and said groove having an end section providing at least one of said supply opening.

17. The discharge nozzle according to claim 1, wherein said nozzle outlet defines an outlet direction, said at least one guiding face having at least one deflecting surface upstream of said at least one distributing chamber, at least one whirl chamber being provided, said at least one supply opening issuing into one of said at least one distributing section substantially equidirectionally with respect to said outlet direction, one of said at least one distributing section providing at least one of an orientation equiaxial with said at least one deflecting surface, constant peripheral cross-sections, at least one sloping guiding face facing said supply opening, a pointed cone facing and pointing against said at least one supply opening, a median longitudinal extension at the most equal to an internal width extension, an end boundary by an insert body, and a chamber outlet.

18. The discharge nozzle according to claim 1, wherein said at least one medium comprises two media and wherein said at least one distributing section provides at least one mixing zone for mixing said two media, means being provided for supplying at least one of said two media under pressure, said first medium being an atomizable medium.

19. The discharge nozzle according to claim 1, wherein there are two supply openings issuing into said distributing chamber, with respective inlet openings issuing into said at least one distributing section, for supplying the first medium and the second medium, respectively, said at least one distributing section having at least one outlet opening and a mixing zone for mixing the first medium and the second medium, said zone for mixing having at least one of a crossing orientation of at least two of said inlet openings, an intermediate chamber cross-sectionally extended with respect to at least one of said inlet openings and said outlet opening, an orientation of a first one of said inlet openings for guiding the second medium around a second inlet opening provided for the first medium, a reception of one of said inlet openings on a projection, an axial orientation of one of said inlet openings provided for the second medium and spaced from a further inlet opening provided for the first medium, a width extension of one of said inlet openings provided for the second medium, said width extension being greater than a width extension of one of said inlet openings for the first medium, at least one of said inlet openings at a first end of said zone for mixing and said outlet opening opposing said first end of said zone for mixing, an overall outlet cross-section of said outlet opening being smaller than an overall inlet cross-section of said outlet opening, and a whirl chamber.

20. The discharge nozzle according to claim 1, wherein the first medium is distributed into said at least one distributing section at a first flow rate, wherein the second medium is distributed into the at least one distributing section at a second flow rate different from the first flow rate and further comprising means in the vicinity of said distributing section for mixing together the first medium and the second medium.

21. The discharge nozzle according to claim 20, wherein said distributing section includes at least one guiding means for uniting substantially separate flows of the first medium and the second medium in the vicinity of at least one outlet of said distributing section, said distributing section having an inner circumference providing at least one longitudinal groove channel, said at least one groove channel providing at least one of a cross-section larger than a cross-section of a first of said supply opening, an outlet opening for said distributing section at an end remote from said supply opening, a media receiver for one of said guiding face bounding a constricted funnel in the vicinity of at least one of said outlet opening, a partial bounding of said outlet opening by an insert body, an open length side circumferentially displaced with respect to a zone of a second of said supply opening oriented transverse to said distributing section, an extension over an entire length extension of said distributing section, an orientation parallel to one of said inlet openings, and a continuous extension into one of said duct sections issuing into one further of said distributing section.

22. The discharge nozzle according to claim 1, further comprising a twisting device for effecting a vortex of the first medium, said twisting device being located upstream of and directly adjacent to one of said supply opening providing a spray cone atomizing nozzle, said atomizing nozzle providing a nozzle projection circumferentially subjected to a flow of the second medium oriented transverse to said nozzle projection.

23. The discharge nozzle according to claim 1, further comprising at least one of a front nozzle body and a rear nozzle body, said at least one nozzle body providing a nozzle cap having a cap end wall and a cap jacket, said nozzle body providing at least one of a perforation of said end wall by at least one of said duct sections, at least one of said duct sections on an inside of said end wall, at least one of said duct section on an inner circumference of said cap jacket, and at least one core body inserted in said cap jacket, said at least one nozzle body bounding at least one of said distributing section, one of said at least one supply opening oriented transverse to said at least one nozzle body, and one of said at least one supply opening oriented parallel to at least one of said at least one nozzle body.

24. The discharge nozzle according to claim 1, further comprising a front nozzle body, a rear nozzle body and a base body, wherein a rear nozzle body and a front nozzle body are mounted on the base body and commonly bound said distributing section, said rear nozzle body having a front face located substantially on a rear face of said front nozzle body, said rear nozzle body providing a nozzle projection spaced with respect to an opposing pointed cone arranged in said frontal nozzle body, said nozzle projection being located in, and said pointed cone outside, a main issuing flow area of a transverse one of said at least one supply opening, a spacing between said pointed cone and said nozzle projection being smaller than an internal width extension of one of said distributing section.

* * * * *